US009898967B2

(12) United States Patent
Liu et al.

(10) Patent No.: US 9,898,967 B2
(45) Date of Patent: Feb. 20, 2018

(54) DRIVING VOLTAGE CONTROL METHOD AND APPARATUS,ARRAY SUBSTRATE, AND DISPLAY DEVICE

(71) Applicant: BOE TECHNOLOGY GROUP CO., LTD., Beijing (CN)

(72) Inventors: Ming Liu, Beijing (CN); Lintao Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 15/095,733

(22) Filed: Apr. 11, 2016

(65) Prior Publication Data

US 2017/0039949 A1 Feb. 9, 2017

(30) Foreign Application Priority Data

Aug. 4, 2015 (CN) ..... 2015 1 0472559

(51) Int. Cl.
*G09G 3/32* (2016.01)
*G09G 3/3258* (2016.01)

(52) U.S. Cl.
CPC ..... *G09G 3/3258* (2013.01); *G09G 2310/08* (2013.01); *G09G 2320/0233* (2013.01);
(Continued)

(58) Field of Classification Search
CPC ..... G09G 3/3258; G09G 3/3233; G09G 2310/08; G09G 2320/0233;
(Continued)

(56) References Cited

U.S. PATENT DOCUMENTS 8,687,025 B2 4/2014 Lee et al.
2006/0038758 A1* 2/2006 Routley ..... G09G 3/3233 345/81

(Continued)

FOREIGN PATENT DOCUMENTS

CN 102074182 A 5/2011
CN 103474016 A 12/2013

(Continued)

OTHER PUBLICATIONS

Chinese Office Action in Chinese Application No. 201510472559.9, Mar. 3, 2017 with English translation.

*Primary Examiner* — Tom Sheng
(74) *Attorney, Agent, or Firm* — Collard & Roe, P.C.

(57) ABSTRACT

A driving voltage control method and apparatus, an array substrate, and a display device, wherein a plurality of predetermined areas (11a) are preset within a display area (11), and corresponding to any of the predetermined areas, the apparatus comprises an acquisition module (21) configured to acquire a luminance value of a pixel cell with the maximum luminance within the predetermined area (11a) in any frame, a search module (22) configured to search a preset table for a corresponding driving voltage value according to the luminance value acquired by the acquisition module and a control module (23) configured to control a driving voltage outputted to all the pixel cells within the predetermined area (11a) in a next frame according to the driving voltage value obtained by the search module. The driving voltage for the display device in any image can be reduced without affecting the display effect of the image.

20 Claims, 2 Drawing Sheets

(52) U.S. Cl.
CPC ..... *G09G 2320/0285* (2013.01); *G09G 2320/0626* (2013.01); *G09G 2330/021* (2013.01)

(58) Field of Classification Search
CPC ... G09G 2320/0285; G09G 2320/0626; G09G 2320/0271; G09G 2330/021
See application file for complete search history.

(56) References Cited

U.S. PATENT DOCUMENTS

| | | | | |
|---|---|---|---|---|
| 2008/0246749 | A1* | 10/2008 | Lee | G09G 3/3233 345/207 |
| 2009/0195484 | A1* | 8/2009 | Lee | G09G 3/3216 345/76 |
| 2011/0115830 | A1* | 5/2011 | Lee | G09G 3/3233 345/690 |
| 2011/0115832 | A1 | 5/2011 | Lee et al. | |
| 2014/0354701 | A1* | 12/2014 | Yeo | G09G 3/3208 345/690 |
| 2015/0097872 | A1* | 4/2015 | Jeong | G09G 3/3225 345/690 |
| 2015/0170577 | A1* | 6/2015 | Bae | G09G 3/3291 345/212 |
| 2016/0155382 | A1* | 6/2016 | Cheon | G09G 3/3233 345/690 |
| 2016/0180763 | A1* | 6/2016 | Park | H01L 27/3276 345/691 |

FOREIGN PATENT DOCUMENTS

| | | | |
|---|---|---|---|
| CN | 103559860 | A | 2/2014 |
| CN | 104517568 | A | 4/2015 |

* cited by examiner

DRIVING VOLTAGE CONTROL METHOD AND APPARATUS,ARRAY SUBSTRATE, AND DISPLAY DEVICE

CROSS REFERENCE TO RELATED APPLICATIONS

Applicant claims priority under 35 U.S.C. § 119 of Chinese Application No. 201510472559.9 filed on Aug. 4, 2015, the disclosure of which is incorporated by reference.

TECHNICAL FIELD

The present disclosure relates to a driving voltage control method and apparatus, an array substrate, and a display device.

BACKGROUND

Among display devices, there is a scheme for reducing power consumption by adjusting a driving voltage at one terminal of a light emitting device. For example, among AMOLED (Active-Matrix Organic Light Emitting Diode) display devices, a cathode voltage of an OLED device may be provided from an external power supply under control of a control waveform outputted by a Time Controller (TCON). Accordingly, by calculating a luminance value of an entire frame of image and finding out a voltage magnitude corresponding to this luminance value, the OLED device can be driven to emit light with a relatively low cathode voltage, by which power consumption of the AMOLED display devices can be reduced.

For an image with a pure grayscale or a relatively uniform luminance, the above scheme can work well, whereas for an image with a relatively large difference between the maximum luminance value and the minimum luminance value, the above scheme cannot achieve the effect of reducing power consumption, or may cause the frame of image to suffer a great loss of luminance, affecting the entire display effect of the display device. However, in common application scenarios, an image with a uniform luminance or a pure grayscale is rare, and therefore the above scheme usually cannot achieve a significant effect of reducing power consumption, or it can achieve the effect of reducing power consumption but with bad affects on the display effect.

SUMMARY

The present disclosure provides a driving voltage control method and apparatus, an array substrate, and a display device, by which the driving voltage of the display device in any image can be reduced without affecting the display effect of the image.

In a first aspect, the present disclosure provides a driving voltage control apparatus for controlling a driving voltage outputted to a plurality of light emitting devices in an array substrate, wherein a display area of the array substrate comprises a plurality of pixel cells each being provided with one light emitting device, a plurality of predetermined areas are preset within the display area with a pixel cell as a minimum unit, and corresponding to any of the predetermined areas, the apparatus comprises:

an acquisition module configured to acquire a luminance value of a pixel cell with the maximum luminance within the predetermined area in any frame;

a search module configured to search a preset table for a corresponding driving voltage value according to the luminance value obtained by the acquisition module; and a control module configured to control, according to the driving voltage value obtained by the search module, a driving voltage outputted to all the pixel cells within the predetermined area in a next frame.

Optionally, each of all the predetermined areas includes pixel cells in multiple rows and multiple columns.

Optionally, each of all the predetermined areas includes pixel cells in predetermined multiple rows and predetermined multiple columns.

Optionally, all the predetermined areas cover together the entire display area.

Optionally, the plurality of predetermined areas include a first predetermined area and a second predetermined area sharing an overlap area; and the control module corresponding to the first predetermined area and/or the second predetermined area is further configured to control a driving voltage outputted to all the pixel cells within the overlap area in a corresponding frame according to a driving voltage value corresponding to the first predetermined area and a driving voltage value corresponding to the second predetermined area.

Optionally, the driving voltage control apparatus further comprises:

a determination module configured, when a maximum difference of the luminance values in a frame is determined to be less than a predetermined threshold, to search the preset table for a corresponding driving voltage value directly according to a luminance maximum, and to control a driving voltage outputted to all the pixel cells in a next frame according to this driving voltage value.

In a second aspect, the present disclosure further provides a driving voltage control method, comprising:

presetting, within a display area of an array substrate, a plurality of predetermined areas with a pixel cell as a minimum unit;

acquiring a luminance value of a pixel cell with a maximum luminance within any predetermined area in any frame;

searching a preset table for a corresponding driving voltage value according to the luminance value; and controlling, according to the driving voltage value, a driving voltage outputted to light emitting devices in all the pixel cells within the predetermined area in a next frame.

Optionally, each of all the predetermined areas includes pixel cells in multiple rows and multiple columns.

Optionally, each of all the predetermined areas includes pixel cells in predetermined multiple rows and predetermined multiple columns.

Optionally, all the predetermined areas cover together the entire display area.

Optionally, the plurality of predetermined areas include a first predetermined area and a second predetermined area sharing an overlap area; and a driving voltage outputted to all the pixel cells within the overlap area in a corresponding frame is controlled according to a driving voltage value corresponding to the first predetermined area and a driving voltage value corresponding to the second predetermined area.

Optionally, the driving voltage control method further comprises:

when a maximum difference of the luminance values in a frame is determined to be less than a predetermined threshold, searching the preset table for a corresponding driving voltage value directly according to a luminance maximum, and controlling a driving voltage outputted to all the pixel cells in a next frame according to this driving voltage value.

In a third aspect, the present disclosure further provides an array substrate, comprising any of the driving voltage control apparatuses described above.

Optionally, the array substrate further comprises a time driving circuit, wherein the control module of the driving voltage control apparatus is provided in or connected with the time driving circuit.

In a fourth aspect, the present disclosure further provides a display device, comprising any of the array substrates described above.

By means of setting predetermined areas in the display area and performing driving voltage control by areas, the present disclosure can decrease situations incapable of reducing power consumption or affecting display effect when setting the same driving voltage for two pixels whose luminance difference is large, or at least can narrow a display range in which such situations may occur. Therefore, the present disclosure can reduce the driving voltage for the display device in any image without affecting the display effect of the image.

Further, the present disclosure breaks through the limitations to application scenarios of the technical solution for controlling the driving voltage to reduce power consumption is applied, which can be applied to all images and can achieve a further reduction of power consumption while ensuring display effect.

Of course, implementing any product or method of the present disclosure does not need to necessarily achieve all the advantages described above at the same time.

DETAILED DESCRIPTION OF THE EMBODIMENTS

To make the objects, technical solutions, and advantages of the present disclosure clearer and more obvious, hereinafter, the technical solutions in the embodiments of the present disclosure will be described clearly and comprehensively in combination with the drawings. Obviously, these described embodiments are only a part of the embodiments of the present disclosure, rather than all of the embodiments thereof.

Figure 1:
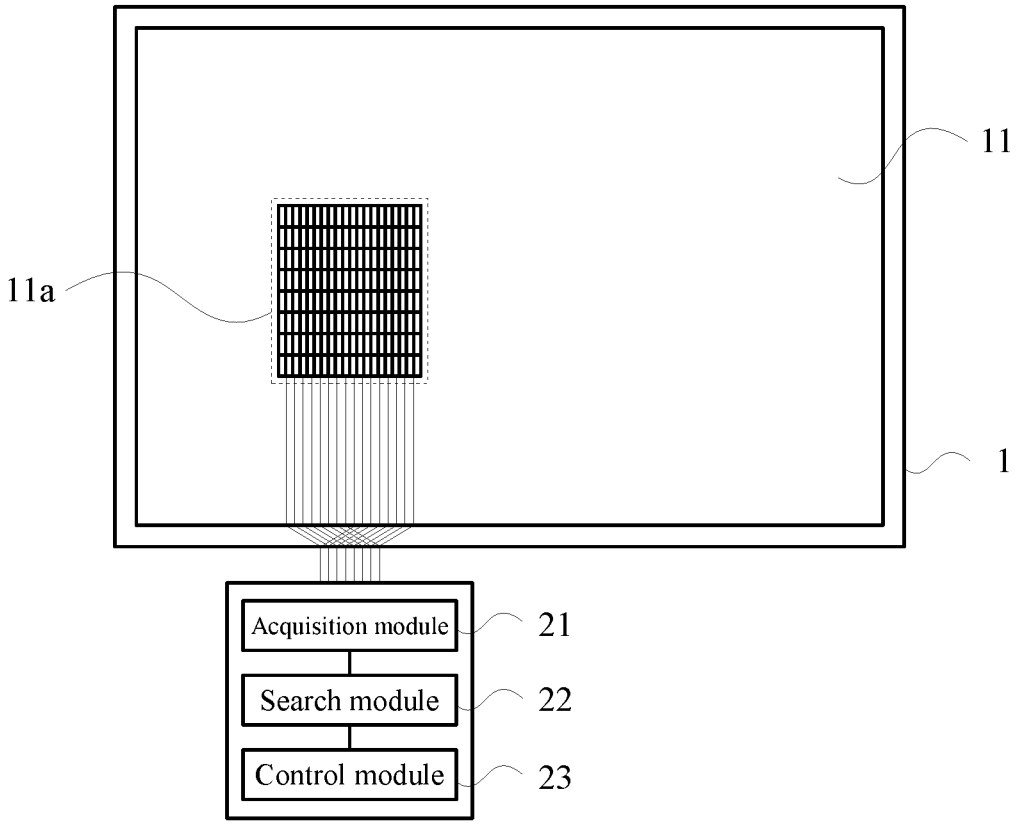
FIG. 1 is a schematic diagram of structure of a driving voltage control apparatus according to an embodiment of the present disclosure.

FIG. 1 is a schematic diagram of structure of a driving voltage control apparatus according to an embodiment of the present disclosure.

Referring to FIG. 1, the driving voltage control apparatus is configured to control a driving voltage outputted to a plurality of light emitting devices in an array substrate 1, wherein a display area 11 of the array substrate 1 includes a plurality of pixel cells (as shown by vertical rectangles in a dotted box, not all of them being shown), each pixel cell being provided with one light emitting device. A plurality of (e.g., two or more) predetermined areas are preset within the display area 11 with a pixel cell as a minimum unit. A predetermined area is a conceptual division of a plurality of pixel cells for facilitating description, for example, the predetermined area 11*a* with a pixel cell as the minimum unit in FIG. 1.

Corresponding to any of the predetermined areas, the driving voltage control apparatus comprises an acquisition module, a search module, and a control module. For example, corresponding to the predetermined area 11*a*, the driving voltage control apparatus comprises:

an acquisition module 21 configured to acquire a luminance value of a pixel cell with the maximum luminance within the predetermined area 11*a* in any frame;

a search module 22 configured to search a preset table for a corresponding driving voltage value according to the luminance value obtained by the acquisition module 21; and a control module 23 configured to control a driving voltage outputted to all the pixel cells within the predetermined area 11*a* in a next frame, according to the driving voltage value obtained by the search module 22.

When the array substrate 1 displays any frame of an image, a voltage across two terminals of a light emitting device in each pixel cell or a current flowing through the light emitting device can drive the light emitting device to emit light with a corresponding luminance, thereby forming light emitting display within the display area 11. Based on this, the acquisition module 21 can acquire a luminance value of a pixel cell with the maximum luminance within the predetermined area 11*a* in the display area 11 in this frame, the search module 22 can search the preset table for the corresponding driving voltage value, an then the control module 23 can control the output of a driving voltage to all the pixel cells within the predetermined area 11*a* in a next frame, wherein the driving voltage is connected to one terminals of the light emitting devices. By means of properly setting the preset table and the control module 23, the light emitting devices in all the pixel cells within the predetermined area 1 1 a can be connected with a proper driving voltage in a next frame, thus reducing the power consumption of these light emitting devices in the next frame.

Figure 2:
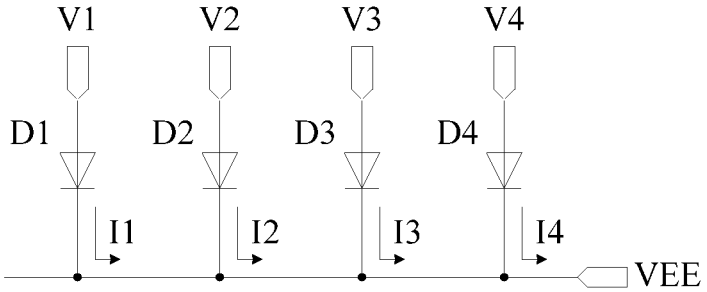
FIG. 2 is a schematic diagram of configuration of a circuit within the same predetermined area of an array substrate according to an embodiment of the present disclosure.

FIG. 2 is a schematic diagram of configuration of a circuit within the same predetermined area of an array substrate according to an embodiment of the present disclosure.

Referring to FIG. 2, second terminals of four light emitting devices D1, D2, D3, D4 in four pixel cells within the same predetermined area are all connected to a driving voltage VEE. First terminals of the light emitting devices D1, D2, D3, D4 are respectively connected to grayscale voltages V1, V2, V3, V4, and the light emitting devices D1, D2, D3, D4 emit lights with corresponding luminance respectively according to a magnitude of a current Il formed by the grayscale voltage V1 and the driving voltage VEE, a magnitude of a current 12 formed by the grayscale voltage V2 and the driving voltage VEE, a magnitude of a current 13 formed by the grayscale voltage V3 and the driving voltage VEE, a magnitude of a current 14 formed by the grayscale voltage V4 and the driving voltage VEE. During displaying the image in the same frame, all the grayscale voltages V1, V2, V3, V4 remain unchanged. Therefore, it can be inferred that magnitudes of the currents I1, I2, I3, I4 decrease as the driving voltage VEE decreases. Without taking into account differences among the light emitting devices D1, D2, D3, D4 and assuming that emission luminance of the light emitting devices is proportional to a current flowing through, the currents I1, I2, I3, I4 flowing through the light emitting devices D1, D2, D3, D4 drop by a certain value every time when the driving voltage VEE reduces by a certain value within a certain range, and thus the emission luminance of the light emitting devices D1, D2, D3, D4 drop with the same level. Based on this, the above preset table can set a proper driving voltage VEE according to a maximum luminance value of the light emitting devices within the same predetermined area, so that the light emitting devices within the same area operate at a relatively low luminance level, thereby reducing power consumption of the light emitting devices.

Similarly, the acquisition module, the search module, and the control module corresponding to each predetermined area within the display area 11 can implement a reduction of power consumption of the light emitting devices of pixel cells within a corresponding range. Therefore, by adopting the driving voltage control apparatus according to the embodiment of the present disclosure, power consumption associated with displaying of the array substrate 1 can be reduced in entirety.

It may be appreciated that the luminance values with which the light emitting devices in the pixel cells emit light in one frame of displayed image are usually distributed in a certain range, and corresponding to a different luminance value, a driving voltage may also be different which can be used to reduce power consumption of the light emitting devices as much as possible. Therefore, the driving voltage suitable for the light emitting devices with a low luminance may cause quite great luminance loss to the light emitting devices with a high luminance Accordingly, in order to make the driving voltage set within one area not to affect the displayed image within the area, the corresponding driving voltage may be set according to the pixel cells with the maximum luminance value, so that a reduction of power consumption of the light emitting devices of all the pixel cells within this area is achieved.

Typically, considering application scenarios and control measures, it is possible to perform driving voltage control as described above within the range of the entire display area. For an image with a pure grayscale or a relatively uniform luminance, such manner can achieve better effect. However, for an image with a relatively large difference between maximum luminance value and minimum luminance value, the effect achieved by such manner is very limited. For example, in the image with a relatively large difference between maximum luminance value and minimum luminance value, the effect in reducing power consumption is almost zero through setting the driving voltage according to the pixel cell with the maximum luminance value, while not setting the driving voltage according to the pixel cell with the maximum luminance value will cause relatively great loss to the luminance value of parts of the pixel cells and affect a normal display effect.

In the embodiment of the present disclosure, predetermined areas are set in the display area, and driving voltage control is performed by areas. Therefore, a great improvement can be made with regard to the problem discussed above. As for the predetermined areas with a relatively low difference between the maximum luminance value and the minimum luminance value in one frame of image, the embodiment of the present application can reduce emission power consumption of the pixel cells therein without causing luminance loss. As for the predetermined areas with a relatively high difference between the maximum luminance value and the minimum luminance value, the embodiment of the present application still can ensure that there is no luminance loss. In general, the embodiment of the present disclosure can reduce the driving voltage for the display device in any image without affecting the display effect of the image.

The embodiment of the present disclosure breaks through the limitations to application scenarios of the technical solution for controlling the driving voltage to reduce power consumption is applied, which can be applied to all images and can achieve a further reduction of power consumption while ensuring display effect.

As shown in FIG. 1, the driving voltage control apparatus according to the embodiment of the present disclosure comprises an acquisition module 21, a search module 22, and a control module 23.

The acquisition module 21 is configured to acquire a luminance value of a pixel cell with the maximum luminance within the predetermined area 11*a* in any frame. Therefore, the acquisition module 21 may be connected to a circuit configuration contained in the array substrate and used to write a luminance value signal to pixel cells, for example, one terminal of the light emitting device, a signal line used to transmit the luminance value signal, or a peripheral circuit used to output the luminance value signal. The acquisition module 21 may include components such as a shift register, a buffer, an analog to digital converter, a magnitude comparator, or a memory etc.

The search module 22 is configured to search a preset table for a corresponding driving voltage value according to the luminance value acquired by the acquisition module 21. Therefore, the search module 22 may be connected to the acquisition module 21, and may be connected to or include a memory storing the preset table, and may also include other logic operators used to perform a search operation.

The control module 23 is configured to control a driving voltage outputted to all the pixel cells within the predetermined area 11*a* in a next frame, according to the driving voltage value obtained by the search module 22. Therefore, the control module 23 may be connected directly to one terminal of the light emitting device which is for connecting the driving voltage, and may also be connected to a circuit configuration that outputs the driving voltage to the light emitting device, and may also include a logic operator used to perform control processing.

In addition, since the one terminal of each of the light emitting devices in all pixel cells within the predetermined area 11*a* are all connected to the same driving voltage, the one terminal for connecting the driving voltage of each of the light emitting devices may be connected together by means of a circuit connecting configuration.

In addition, in a case where the array substrate is provided with a peripheral circuit outside the display area 11, respective parts of the above driving voltage control apparatus may be connected to the peripheral circuit, and may also be disposed in the peripheral circuit. The present disclosure makes no limitations thereto. Furthermore, in the driving voltage control apparatus, the acquisition module and/or search module and/or control module corresponding to any plurality of different predetermined areas may be implemented by the same circuit configuration.

In FIG. 1, connection lines between the predetermined area 11*a* and the part including the acquisition module 21, the search module 22 and the control module 23 only represent correspondence relationship between the two, rather than that the array substrate 1 or the driving voltage control apparatus must include such electrical connection lines.

In addition, the predetermined areas (for example, the predetermined area 11*a*) do not necessarily have a rectangular shape. They may be, for example, square, round, trapezoidal, or any other geometric shapes. Furthermore, the quantity of the predetermined areas, and the size, shape, and coverage area of each predetermined area may be set according to a specific application scenario. The present disclosure makes no limitations thereto. For example, all the predetermined areas can be made to cover together the entire display area, for example, several predetermined areas are made to cover the entire image, thus ensuring the control effect on the driving voltage within the image in the entire frame.

In addition, the pixel cells included in the predetermined area are not necessarily arranged in rows and columns. For a different type of array substrate, a corresponding manner for dividing the predetermined area may be employed. Of course, for a typical array substrate in which pixel cells are arranged in rows and columns, each of all the predetermined areas may include pixel cells in multiple rows and multiple columns, so as to acquire the luminance value and control an output of the driving voltage. Furthermore, it is possible to make each of all the predetermined areas include pixel cells in predetermined multiple rows and predetermined multiple columns (e.g., 100 rows×160 columns), so that all the predetermined areas have the same specification, which helps to ensure uniformity of the entire image.

Figure 3:
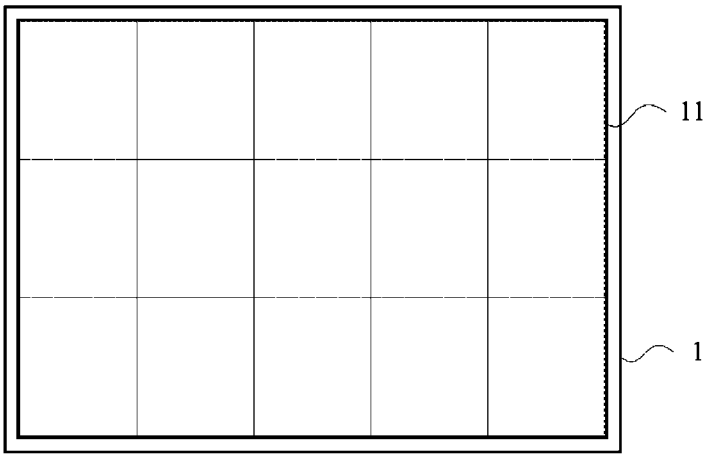
FIG. 3 is a schematic diagram of a way of setting the predetermined areas according to an embodiment of the present disclosure.

FIG. 3 is a schematic diagram of a way of setting the predetermined areas according to an embodiment of the present disclosure. The display area 11 of the array substrate 1 may be divided into 15 predetermined areas each with the same specification of 3 rows×5 columns, as shown in FIG. 3. In addition, all the predetermined areas should cover together the entire display area 11.

In addition, different predetermined areas may partially overlap. For example, the plurality of predetermined areas may be made to include a first predetermined area and a second predetermined area sharing an overlap area. Correspondingly, the control module corresponding to the first predetermined area and/or the second predetermined area is further configured to control a driving voltage outputted to all the pixel cells within the overlap area in a corresponding frame, according to a driving voltage value corresponding to the first predetermined area and a driving voltage value corresponding to the second predetermined area. That is to say, within the overlap area, it is possible to select the proper driving voltage control manner in conjunction with the driving voltage values within two predetermined areas, thereby weakening visual difference between the two predetermined areas, and avoiding appearance of visible traces at a junction of the predetermined areas.

In other embodiments of the present disclosure, the driving voltage control apparatus may further comprise a determination module (not shown) configured to, when determining a maximum difference of the luminance values in a frame is less than a predetermined threshold, search the preset table for the corresponding driving voltage value directly according to a luminance maximum, and control a driving voltage outputted to all the pixel cells in a next frame according to the driving voltage value. Therefore, when the image is an image with a pure grayscale or a relatively uniform luminance, it can simplify the process of controlling the driving voltage, so as to enhance response speed and reduce cost.

An embodiment of the present disclosure further provides an array substrate comprising any of the driving voltage control apparatuses described above. The driving voltage control apparatus may be provided within a peripheral circuit outside the display area of the array substrate, and also may be connected with or partially overlapped with the circuit configuration provided on the array substrate for driving the pixel cells to display. For example, the array substrate may comprise a time driving circuit configured to control output of the driving voltage. Correspondingly, the control module of the driving voltage control apparatus may be provided in the time driving circuit or be connected to the time driving circuit. Therefore, the array substrate according to the embodiment of the present application can be implemented with a simple addition and remodeling, which helps to reduce cost. Because of comprising any of the above driving voltage control apparatuses, the array substrate can solve the same technical problem and achieve the corresponding technical effects.

Figure 4:
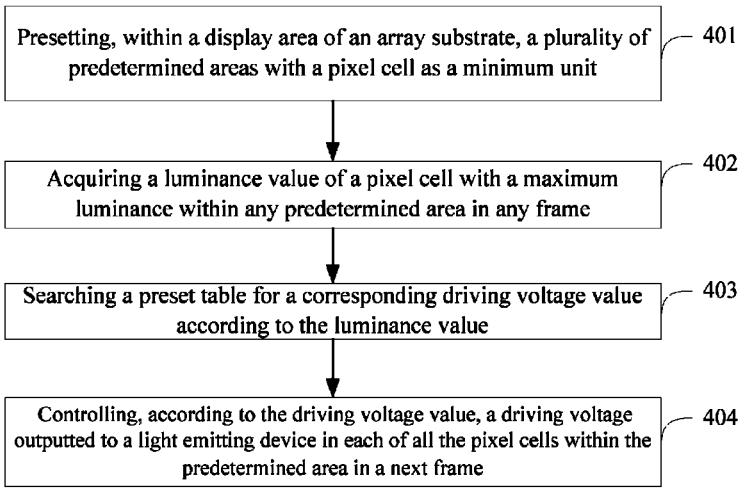
FIG. 4 is a flowchart of a driving voltage control method according to an embodiment of the present application.

An embodiment of the present disclosure further provides a driving voltage control method. FIG. 4 is a flowchart of a driving voltage control method according to an embodiment of the present application.

Referring to FIG. 4, the method comprises:

step 401: presetting, with a pixel cell as a minimum unit, a plurality of predetermined areas within a display area of an array substrate;

step 402: for any predetermined area, acquiring a luminance value of a pixel cell with a maximum luminance within the predetermined area in any frame;

step 403: searching a preset table for a corresponding driving voltage value according to the luminance value; and step 404: controlling, according to the driving voltage value, a driving voltage outputted to a light emitting device in each of all the pixel cells within the predetermined area in a next frame.

The method corresponds to any of the driving voltage control apparatuses or any of the array substrates described above, wherein the manner of setting the plurality of predetermined areas in the step 401 may be the same with any of the manner described above, implementations for steps 402 to 404 may be processes implemented by the functions of any acquisition module 21, search module 22, and control module 23 described above. Of course, steps 402 to 404 may not be fixed, and may, for example, be performed in other different sequences. Accordingly, the method according to the embodiment of the present disclosure can solve the same technical problem and achieve the same technical effects.

Herein, the predetermined areas (for example, the predetermined area 11*a*) are not necessarily with a rectangular shape. They may be, for example, square, round, trapezoidal, or any other geometric shapes. Furthermore, the quantity of the predetermined areas, and the size, shape, and coverage area of each predetermined area may be set according to a specific application scenario. The present disclosure makes no limitations thereto. For example, all the predetermined areas can be made to cover together the entire display area, for example, several predetermined areas are made to cover the entire image, thus ensuring the control effect on the driving voltage within the image in the entire frame.

In addition, the pixel cells included in the predetermined area are not necessarily arranged in rows and columns. For a different type of array substrate, a corresponding manner for dividing the predetermined area may be employed. Of course, for a typical array substrate in which pixel cells are arranged in rows and columns, each of all the predetermined areas may include pixel cells in multiple rows and multiple columns, so as to acquire the luminance value and control an output of the driving voltage. Furthermore, it is possible to make each of all the predetermined areas include pixel cells in predetermined multiple rows and predetermined multiple columns (e.g., 100 rows×160 columns), so that all the predetermined areas have the same specification, this helps to ensure uniformity of the entire image. Further, all the predetermined areas ha should cover together the entire display area 11.

In addition, different predetermined areas may partially overlap. For example, the above step 404 may comprise the following step:

step 404*a*: controlling a driving voltage outputted to all the pixel cells within the overlap area in a corresponding frame, according to a driving voltage value corresponding to the first predetermined area and a driving voltage value corresponding to the second predetermined area.

That is to say, within the overlap area, it is possible to select the proper driving voltage control manner in conjunction with the driving voltage values within two predetermined areas, thereby weakening visual difference between the two predetermined areas, and avoiding appearance of visible traces at a junction of the predetermined areas.

On the other hand, prior to step 403, the following step may be further comprised:

step 402*a*: when determining a maximum difference of the luminance values in a frame is less than a predetermined threshold, searching the preset table for the corresponding driving voltage value directly according to a luminance maximum, and controlling a driving voltage outputted to all the pixel cells in a next frame according to the driving voltage value.

It can be seen that, an implementation of step 402*a* is an operating process of the determination module described above, no more details repeated here.

An embodiment of the present application further provides a display device, comprising any of the array substrate described above. It should be noted that the display device in the embodiment may be display panel, electronic paper, mobile phone, tablet, TV set, laptop, digital photo frame, navigator and any other products or components with a display function. Since the display device comprises any of the array substrates described above, it can solve the same technical problems and achieve the same technical effect.

In the description of the present disclosure, it should be noted that orientation or position relationships indicated by the terms "above", "under" etc. are orientation or position shown based on the drawings, which are only to facilitate describing the present disclosure and simplifying the description, rather than to indicate or imply that the device or element referred must have a particular orientation, constructed or operated with a particular orientation, and therefore cannot be construed as limiting the present disclosure. Unless otherwise expressly specified and limited, the terms "installation", "connected", "connection" should be broadly understood, for example, it may be fixedly connected, or removably connected, or integrally connected; it may also be mechanically connected, or electrically connected; it may also be directly connected, or indirectly connected through an middleware, or two components may be internally communicated. For those of ordinary skill in the art, the meaning of the aforesaid terms in the present disclosure should be understood according to practice.

It should be also noted that, in the specification, the relationship terms such as "first", "second", and so on are used only to differentiate one entity or operation from another entity or operation, not necessarily requiring or implying that these entities or operations have any of such actual relationships or sequences. And the terms "comprise", "include" and any other variations thereof intend to cover nonexclusive inclusion so that the procedure, the method, the product or the equipment including a series of elements include not only these elements, but also other elements which are not listed explicitly, or also include inherent elements of these procedure, method, product or equipment. In the case that there is no further limitation, elements defined by the expressions "comprise one . . . " do not exclude there being additional identity elements in the procedure, method, product or equipment of the elements.

The above embodiments are merely exemplary ones adopted for explaining the technical solutions of the present disclosure, rather than limiting the present disclosure. Although the present disclosure has been described in detail with reference to the embodiments of, those of ordinary skill in the art should understand that various modifications may also be made to the technical solutions recorded in the preceding embodiments, or parts of the technical features thereof may be replaced by equivalents, and essence of the corresponding technical solutions with these modifications or replacements still falls into the spirit and scope of the embodiments of the present disclosure.

The present application claims priority of the Chinese Patent Application No. 201510472559.9 filed on Aug. 4, 2015, the entire disclosure of which is hereby incorporated in full text by reference as part of the present application.

What is claimed is:

1. A driving voltage control apparatus for controlling a driving voltage outputted to a plurality of light emitting devices in an array substrate, wherein a display area of the array substrate includes a plurality of pixel cells, each pixel cell being provided with one light emitting device, a plurality of predetermined areas are preset within the display area with a pixel cell as a minimum unit, and corresponding to any of the predetermined areas, the driving voltage control apparatus comprises:

an acquisition module configured to acquire a luminance value of a pixel cell with the maximum luminance within the predetermined area in any frame;

a search module configured to search a preset table for a corresponding driving voltage value according to the luminance value acquired by the acquisition module; and a control module configured to control a driving voltage outputted to all the pixel cells within the predetermined area in a next frame, according to the driving voltage value obtained by the search module.

2. The driving voltage control apparatus according to claim 1, wherein each of all the predetermined areas includes pixel cells in multiple rows and multiple columns.

3. The driving voltage control apparatus according to claim 2, wherein each of all the predetermined areas includes pixel cells in predetermined multiple rows and predetermined multiple columns.

4. The driving voltage control apparatus according to claim 1, wherein all the predetermined areas cover together the entire display area.

5. The driving voltage control apparatus according to claim 1, wherein the plurality of predetermined areas include a first predetermined area and a second predetermined area sharing an overlap area; and a control module corresponding to the first predetermined area and/or the second predetermined area is further configured to control a driving voltage outputted to all the pixel cells within the overlap area in a corresponding frame, according to a driving voltage value corresponding to the first predetermined area and a driving voltage value corresponding to the second predetermined area.

6. The driving voltage control apparatus according to claim 1, further comprising:

a determination module configured, when a maximum difference of the luminance values in a frame is determined to be less than a predetermined threshold, to search the preset table for a corresponding driving voltage value directly according to a luminance maximum, and to control a driving voltage outputted to all the pixel cells in a next frame according to this driving voltage value.

7. An array substrate comprising the driving voltage control apparatus according to claim 1.

8. The array substrate according to claim 7, further comprising a time driving circuit, wherein the control module of the driving voltage control apparatus is provided in or connected to the time driving circuit.

9. A display device comprising the array substrate according to claim 7.

10. The display device according to claim 9, wherein the array substrate further comprises a time driving circuit and a control module of the driving voltage control apparatus in the array substrate is provided in or connected to the time driving circuit.

11. The display device according to claim 9, wherein, in the driving voltage control apparatus of the array substrate, a plurality of predetermined areas include a first predetermined area and a second predetermined area sharing an overlap area, and a control module corresponding to the first predetermined area and/or the second predetermined area is further configured to control a driving voltage outputted to all the pixel cells within the overlap area in a corresponding frame, according to a driving voltage value corresponding to the first predetermined area and a driving voltage value corresponding to the second predetermined area.

12. The display device according to claim 9, wherein, in the array substrate, the driving voltage control apparatus further comprises:

a determination module configured, when a maximum difference of the luminance values in a frame is determined to be less than a predetermined threshold, to search the preset table for a corresponding driving voltage value directly according to a luminance maximum, and to control a driving voltage outputted to all the pixel cells in a next frame according to this driving voltage value.

13. The array substrate according to claim 7, wherein, in the driving voltage control apparatus, a plurality of predetermined areas include a first predetermined area and a second predetermined area sharing an overlap area, and a control module corresponding to the first predetermined area and/or the second predetermined area is further configured to control a driving voltage outputted to all the pixel cells within the overlap area in a corresponding frame, according to a driving voltage value corresponding to the first predetermined area and a driving voltage value corresponding to the second predetermined area.

14. The array substrate according to claim 7, wherein the driving voltage control apparatus further comprises:

a determination module configured, when a maximum difference of the luminance values in a frame is determined to be less than a predetermined threshold, to search the preset table for a corresponding driving voltage value directly according to a luminance maximum, and to control a driving voltage outputted to all the pixel cells in a next frame according to this driving voltage value.

15. A driving voltage control method, comprising:

presetting, within a display area of an array substrate, a plurality of predetermined areas with a pixel cell as a minimum unit;

acquiring a luminance value of a pixel cell with a maximum luminance within any predetermined area in any frame;

searching a preset table for a corresponding driving voltage value according to the luminance value; and controlling, according to the driving voltage value, a driving voltage outputted to a terminal of a light emitting device in each of all the pixel cells within the predetermined area in a next frame.

16. The driving voltage control method according to claim 15, wherein each of all the predetermined areas includes pixel cells in multiple rows and multiple columns.

17. The driving voltage control method according to claim 16, wherein each of all the predetermined areas includes pixel cells in predetermined multiple rows and predetermined multiple columns.

18. The driving voltage control method according to claim 15, wherein all the predetermined areas cover together the entire display area.

19. The driving voltage control method according to claim 15, wherein the plurality of predetermined areas include a first predetermined area and a second predetermined area sharing an overlap area, and a driving voltage outputted to all the pixel cells within the overlap area in a corresponding frame is controlled according to a driving voltage value corresponding to the first predetermined area and a driving voltage value corresponding to the second predetermined area.

20. The driving voltage control method according to claim 15, further comprising:

when a maximum difference of the luminance values in a frame is determined to be less than a predetermined threshold, searching the preset table for a corresponding driving voltage value directly according to a luminance maximum, and controlling a driving voltage outputted to all the pixel cells in a next frame according to this driving voltage value.

* * * * *